United States Patent [19]

Suzuki et al.

[11] Patent Number: 4,965,163

[45] Date of Patent: Oct. 23, 1990

[54] LIQUID DEVELOPER FOR ELECTROSTATIC IMAGE

[75] Inventors: Nobuo Suzuki; Yutaka Sakasai; Tetuo Usui, all of Kanagawa, Japan

[73] Assignee: Fuji Photo Film Co., Ltd., Kanagawa, Japan

[21] Appl. No.: 315,064

[22] Filed: Feb. 24, 1989

[30] Foreign Application Priority Data

Feb. 24, 1988 [JP] Japan ..... 63-41272
Feb. 24, 1988 [JP] Japan ..... 63-41273

[51] Int. Cl.[5] ..... G03G 9/13
[52] U.S. Cl. ..... 430/114; 430/119
[58] Field of Search ..... 430/114, 116; 252/62.1 L, 119

[56] References Cited

U.S. PATENT DOCUMENTS 4,156,034 5/1979 Mukoh et al. ..... 430/116
4,161,453 7/1979 Gilliams et al. ..... 430/116
4,631,244 12/1986 Mitchell ..... 430/137
4,670,370 6/1987 Taggi ..... 430/137
4,702,984 10/1987 El-Sayed et al. ..... 430/115
4,702,985 10/1987 Larson ..... 430/115
4,707,429 11/1987 Trout ..... 430/115
4,734,352 3/1988 Mitchell ..... 430/115
4,758,494 7/1988 El-Sayed ..... 430/137
4,760,009 7/1988 Larson ..... 430/137
4,794,651 12/1988 Landa et al. ..... 430/110
4,798,778 1/1989 El-Sayed et al. ..... 430/115

*Primary Examiner*—John L. Goodrow
*Attorney, Agent, or Firm*—Sughrue, Mion, Zinn, Macpeak & Seas

[57] ABSTRACT

A liquid developer for development of electrostatic latent images comprising a carrier liquid containing at least one copolymer of formula (I):

(I)

wherein $R_1$ is a hydrogen atom or a methyl group; $R_2$ is an alkyl, aralkyl, aryl or cycloalkyl group, which may be substituted; and x and y eash is a number to satisfy the condition of x/y=0.995 to 0.80/0.005 to 0.20 on a molar basis. By incorporation of the copolymer, the transferability, dispersibility and fixability of the developer are improved.

10 Claims, No Drawings

LIQUID DEVELOPER FOR ELECTROSTATIC IMAGE

FIELD OF THE INVENTION

The present invention relates to a liquid developer which is used for development of electrostatic latent images and which has improved transferability, dispersibility and image-forming characteristic.

BACKGROUND OF THE INVENTION

In general, a liquid developer which is used for development of electrostatic latent images comprises a coloring agent such as carbon black or various kinds of pigments, a coating agent which adheres to or coats over the coloring agent thereby to adjust the charge degree of toner grains, to accelerate the dispersibility thereof and to enhance the fixability thereof after development, a dispersing agent which is dissolved in or swollen by a carrier liquid thereby to enhance the dispersion stability of toner grains, a charge adjusting agent to adjust the amount of the charge of the toner grains and a carrier liquid having a high electric resistance ($10^9$ to $10^{15}$ $\Omega\cdot$cm).

Suitable coating agents are, for example, rubbers such as butadiene rubber, styrene-butadiene rubber, cyclic rubber or natural rubber, synthetic resins such as styrene resins, vinyltoluene resins, acrylic resins, methacrylic resins, polyester resins, polycarbonates, polyvinyl acetates or ethylene copolymers, alkyd resins or modified alkyd resins such as rosin resins, hydrogenated rosin resins or linseed oil-modified alkyd resins, and natural resins such as polyterpene resins. In addition, phenol resins and modified phenol resins such as phenol-formaldehyde resins, as well as natural resin-modified maleic acid resins, pentaerythric phthalate, chroman-indene resins, ester gum resins and vegetable oil-polyamides are known. Among them, ethylene copolymers are especially mentioned which are excellent for transfer printing.

JP-A-No. 61-180248 (the term "JP-A" as used herein refers to a "published unexamined Japanese patent application") mentions an example of using ethylene/methacrylic acid copolymer as an ethylene copolymer. However, as the copolymer has a large internal cohesive force because of the carboxyl group thereof, the dispersibility thereof is still insufficient even with the plasticizing method as suggested therein, where the copolymer is heated at a temperature higher than the softening point thereof in the presence of Isopar L, and therefore the copolymer is hardly formed into fine grains. Because of the poor dispersion stability of the copolymer, the precipitation of the toner grains is noticeable causing various problems in actual development operation that the line images printed are rough and the resolving power is poor. JP-A-No. 62-209543 mentions an example of using a polar solvent as a means of dispersing the copolymer. However, this approach could not be said to be always preferable for a liquid developer containing an electric insulating nonaqueous solvent as a carrier liquid because of the charge characteristic thereof. JP-A-No. 58-129438 mentions a method of preparing toner grains by heating and dissolving an ethylenic copolymer such as an ethylene-vinyl acetate copolymer in a solvent and then cooling the same. However, this method also has some drawbacks that the polymer separates out from the coloring agent during dissolution thereof and the grain size of the grains to be precipitated out during cooling is often nonuniform. As will be noted from the examples, conventional ethylene copolymers have a problem in terms of the dispersibility thereof. Almost no other polymers have hitherto been found out, which have excellent transferability, dispersibility and fixability.

When conventional ethylene copolymers are used as a coating agent for a liquid developer, the dispersibility is poor although the transferring efficiency is good. Accordingly, the dispersion stability is poor and the toner grains precipitate in a short period of time so that the resolving characteristic is insufficient and the image reproducibility is poor. Such are serious problems.

SUMMARY OF THE INVENTION

A first object of the present invention is to provide a liquid developer for electrostatic images, which has excellent transferability as well as dispersibility and fixability.

A second object of the present invention is to provide a liquid developer for electrostatic images, which has excellent image reproducibility and which provides an image quality with high resolving power.

A third object of the present invention is to provide a liquid developer for use as a toner for lithographic printing, which provides electrostatic images having a high printing durability.

In order to overcome the problems of the prior art and to attain the objects of the present invention, this invention provides a liquid developer for electrostatic images, which comprises a carrier liquid containing, as a component thereof, at least one copolymer of the general formula (I):

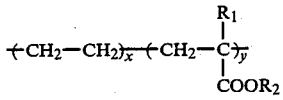

(I)

wherein $R_1$ represents a hydrogen atom or a methyl group; $R_2$ represents an alkyl group, an aralkyl group, an aryl group or a cycloalkyl group; x and y each represents a number to satisfy the condition of $x/y=0.995$ to $0.80/0.005$ to 0.2 on a molar basis. The alkyl, aralkyl, aryl or cycloalkyl group for $R_2$ may optionally be substituted by any other substituent(s).

DETAILED DESCRIPTION OF THE INVENTION

The ethylene copolymers for use in the present invention are substantially insoluble in or swellable with the carrier liquid and are used as a coating agent for colorants. These function to form toner grains and impart fixability thereto. For use as a toner for lithographic printing, a colorant is not always necessary so that the copolymer may be used alone to form toner grains.

Hitherto, ethylene vinyl acetate copolymers, ethylene/methacrylic acid copolymers and ethylene/ethyl acrylate copolymers have been used as the ethylene copolymers in a liquid developer.

Although these ethylene copolymers often displayed good transferability when used for transfer printing, these had poor dispersibility so that when formed into a developing agent, the toner grains noticeably precipitated. Further, as these could not be formed into fine grains, coarse toner grains were used in development only to give low quality images with noticeable rough line images because of the roughness of the coarse grains. Regarding the utility of liquid developer, excellent transferability is of course important when used for transfer printing, but high dispersibility is also as important as the former. In particular, the degree of dispersion is said to determine the image-forming characteristic of the liquid developer, such as the resolving power thereof.

The present invention improves the dispersibility of fine grains in a liquid developer and makes the best use of the excellent transferability of ethylene copolymers.

In order to achieve sufficient dispersibility, a component which is compatible with the carrier liquid is necessary. The present inventors have found that alkyl (meth)acrylates of the formula (I) are effective for improving the dispersibility, as the copolymer component to the ethylene in ethylene copolymers, while maintaining the excellent transferability and fixability of the ethylene copolymers.

The ethylene copolymers of the formula (I) for use in the present invention are explained in detail hereunder.

In the formula (I), $R_2$ may be an unsubstituted or substituted alkyl group. Examples of suitable alkyl groups include n-propyl, n-butyl, n-amyl, n-hexyl, n-octyl, decyl, dodecyl, myristyl, cetyl and stearyl groups. The number of the carbon atoms in the alkyl group is preferably from 3 to 22.

When $R_2$ represents an unsubstituted or substituted aralkyl group, examples of suitable aralkyl groups include benzyl, phenethyl, 1-naphthylmethyl, 2-naphthylmethyl, 1-anthrylmethyl, 2-anthrylmethyl and benzhydryl group. The number of the carbon atoms in the unsubstituted or substituted aralkyl group is preferably from 7 to 22.

When $R_2$ represents an unsubstituted or substituted aryl group, examples of suitable aryl groups include phenyl, 1-naphthyl, 2-naphthyl, 1-anthryl and 2-anthryl groups. The number of the carbon atoms in the unsubstituted or substituted aryl group is preferably from 6 to 18.

When $R_2$ represents an unsubstituted or substituted cycloalkyl group, examples of suitable cycloalkyl groups include cyclopentyl, cyclohexyl and cycloheptyl groups. The number of the carbon atoms in the unsubstituted or substituted cycloalkyl group is preferably from 4 to 12.

Suitable substituents for these groups are, for example, an alkyl group having up to 12 carbon atoms, an alkyloxy group having up to 12 carbon atoms, an aryloxy group having from 6 to 14 carbon atoms, an alkyloxycarbonyl group having up to 12 carbon atoms, an aryloxycarbonyl group having from 6 to 14 carbon atoms, a dialkylcarbonyl group having up to 12 carbon atoms, a diarylcarbonyl group having from 13 to 28 carbon atoms, an alkylarylcarbonyl group having from 8 to 18 carbon atoms, a hydroxyl group, a carboxyl group, a cyano group, a nitro group, a sulfonic acid group, a cycloalkyl group having from 4 to 12 carbon atoms, an aryl group having from 6 to 14 carbon atoms, an aralkyl group having from 7 to 14 carbon atoms, and a halogen atom, and these substituents may further be substituted by any other substituents such as with these substituents.

When the substituents are selected from an alkyl group, an alkyloxy group, an alkyloxycarbonyl group, a dialkylcarbonyl group and an alkylarylcarbonyl group, the alkyl moiety therein may be a linear or branched alkyl group, examples of which include methyl, ethyl, n-propyl, isopropyl, n-butyl, isobutyl, t-butyl, n-amyl, isoamyl, n-hexyl, n-octyl, 2-ethylhexyl, decyl and dodecyl groups.

When the substituents are selected from an aryl group, an aryloxy group, an aryloxycarbonyl group, a diarylcarbonyl group and an alkylarylcarbonyl group, examples of the aryl moiety therein include phenyl, 1-naphthyl, 2-naphthyl, 1-anthryl and 2-anthryl group.

When the substituents are selected from a cycloalkyl group and an aralkyl group, the abovedescribed examples of cycloalkyl groups are suitable.

Other substituents include a hydroxyl group, a carbonyl group, a cyano group, a nitro group, a sulfonic acid group and a halogen atom such as fluorine, chlorine and bromine atoms.

Preferably, $R_2$ represents an unsubstituted or substituted alkyl group having 3 or more carbon atoms, a benzyl group or an aralkyl group having an alkyl group with 2 or more carbon atoms. In addition, groups having a sulfonic acid group as a substituent are also preferred for $R_2$.

In another embodiment of the present invention, this invention provides a liquid developer containing a terpolymer formed by introducing (meth)acrylic acid into ethylene copolymers. By incorporation of the terpolymer, the dispersing characteristic of the liquid developer has been improved by making the best use of the excellent transferability of the ethylene copolymer and still maintaining satisfactory fixability and printing durability because of the carboxyl group in the terpolymer. The terpolymer for use in the present invention for this purpose can be represented by the following general formula (II):

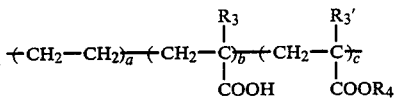

(II)

wherein $R_3$ and $R_3'$ each has the same meaning as $R_1$ in the formula (I); $R_4$ has the same meaning as $R_2$ in the formula (I); and a, b and c each represents a number to satisfy the condition of a/b/c=0.99 to 0.80/0.005 to 0.195/0.195 to 0.005 on a molar basis.

Specific examples for $R_1$ and $R_2$ of formula (I) are suitable for $R_3$, $R_3'$ and $R_4$ as well.

Especially preferably, $R_4$ represents an unsubstituted or substituted alkyl group having 6 or more carbon atoms, a benzyl group, an aralkyl group having an alkyl group with 2 or more carbon atoms. In addition, groups having a sulfonic acid group as a substituent are also preferred for $R_4$.

The copolymers for use in the present invention have a molecular weight of from 10,000 to 1,000,000 (weight average), preferably from 20,000 to 500,000, as measured by the GPC method. They have a melt flow rate of from 0.3 to 800 (g/10 min), preferably from 0.5 to 500 (g/10 min), as measured by JIS K-6730 method.

Specific examples of the copolymers for use in the present invention are mentioned hereunder, which, however, are not intended to restrict the scope of the present invention.

1.
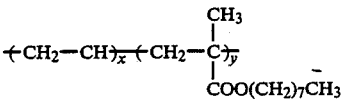
x:y = 0.964:0.036
(molar ratio - the same hereafter)
2.
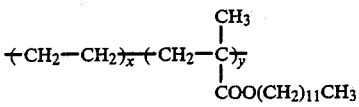
x:y = 0.964:0.036
3.
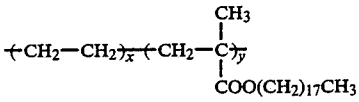
x:y = 0.964:0.036
4.
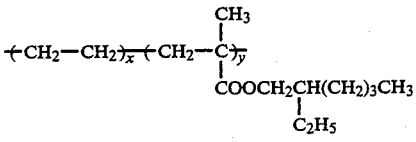
x:y = 0.964:0.036
5.
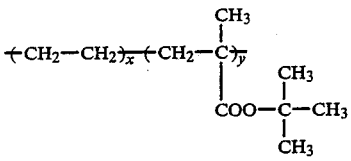
x:y = 0.95:0.05
6.
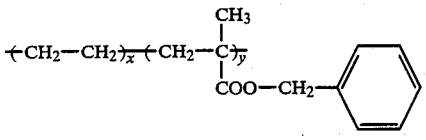
x:y = 0.95:0.05
7.
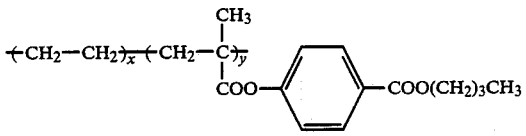
x:y = 0.95:0.05
8.
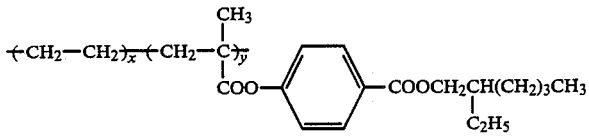
x:y = 0.964:0.036
9.
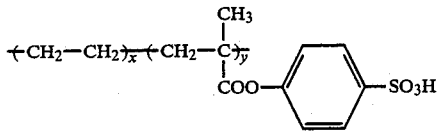
x:y = 0.964:0.036
10.
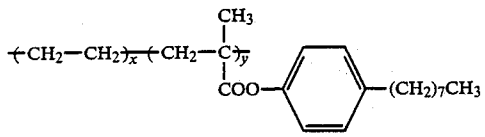
x:y = 0.95:0.05

-continued

11.

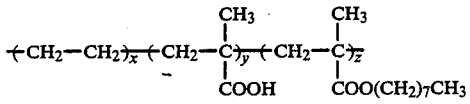

x:y:z = 0.964:0.018:0.018

12.

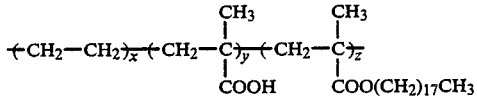

x:y:z = 0.964:0.018:0.018

13.

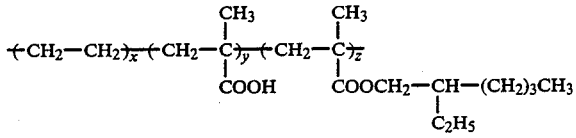

x:y:z = 0.964:0.018:0.018

14.

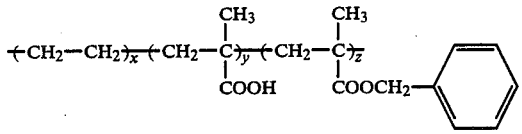

x:y:z = 0.95:0.025:0.025

15.

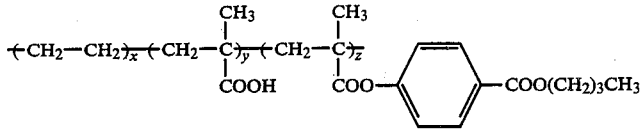

x:y:z = 0.964:0.018:0.018

16.

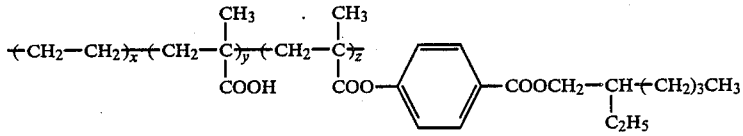

x:y:z = 0.964:0.018:0.018

17.

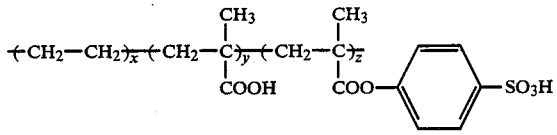

x:y:z = 0.95:0.025:0.025

18.

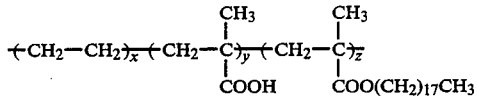

x:y:z = 0.964:0.03:0.006

The copolymers used in the present invention are generally prepared by a process of bulk polymerization, solution polymerization, suspension polymerization or emulsion polymerization. Specifically, a high pressure polymerization in the presence of a free radical initiator, a medium pressure polymerization in the presence of a transition metal compound, and a medium or low pressure polymerization in the presence of a transition metal halide and an alkylaluminum compound. As a further process, the copolymers of the present invention may also be prepared from a starting material ethylene/methacrylic acid copolymer. Specifically, the copolymers of the formula (I) can be prepared by applying an acid chloride reagent to the carboxyl group of a commercial ethylene/methacrylic acid copolymer to convert the group into an acid chloride group and thereafter esterifying the resulting group with appropriate alcohols. The copolymers of the formula (II) can be prepared by applying an acid chloride reagent to the carboxyl group of an ethylene/methacrylic acid copolymer to convert the group into an acid chloride group and thereafter partially esterifying the resulting group with an alcohol in an amount necessary for the esterification while the remaining acid chloride is decomposed with water to a free carboxyl group. The procedures of bulk polymerization, solution polymerization, suspension polymerization or emulsion polymerization which can be used to produce the copolymers employed in the claimed invention are described in, for example, Murahashi Shunsuke et al., *Gosei Kobunshi* (*Synthetic Polymers*) (published by K. K. Asakura Shoten, Japan, 1970) and Ohtsu Takayuki et al., *Kobunshi Gosei no Jikkenho* (*The Experi-*

*ment for Synthesis of High Polymers*), (published by Kagaku Dojin, Japan, 1972).

The method of using an ethylene/methacrylic acid copolymer as a starting material has various advantages in that alcohols of a broad range can be selected for esterification, the reaction is relatively easy and a large-scaled apparatus (such as high pressure reactor) is unnecessary, as shown in the production examples mentioned below.

Production examples of illustrating preparation of the copolymers of the present invention are described below.

PRODUCTION EXAMPLE 1

Production of Compound No. 2

1 liter of toluene and 100 g of ethylene/methacrylic acid copolymer (ethylene/methacrylic acid copolymerization ratio of 0.964/0.036, by mol) (Nuclel N-699, a trade name, manufactured by Mitsui Du Pont Polychemical Co.) were added to a 2-liter 4-neck container equipped with a reflux condenser with a quantitative water receiver, a stirring blade, a thermometer and an additive-introducing means, and the contents were heated under reflux in an $N_2$ atmosphere, whereupon 50 ml of the contents was distilled out. After cooling to 60° C., 15 g of thionyl chloride was gradually added, and 45 g of dodecyl alcohol was further added after 1 hour. The temperature was increased to 65° C. and the contents were again reacted for 20 hours. After the reaction, the reaction solution was poured into 3 liters of methanol for precipitation. Then the precipitate formed was filtered and washed with methanol. After drying, the IR spectrum of the product was measured, whereby complete esterification of the carboxyl group with dodecyl alcohol was confirmed.

Compound Nos. 1, 3, 4, 8 and 9 were also prepared by the same method as above by using ethylene/methacrylic acid copolymer (ethylene/methacrylic acid copolymerization ratio of 0.964/0.036, by mol) (Nuclel N-699) as a starting material and by replacing dodecyl alcohol by the other alcohols for esterification. Compound Nos. 5, 6, 7 and 10 were also prepared by the same method as above by using ethylene/methacrylic acid copolymer (ethylene/methacrylic acid copolymerization ratio of 0.95/0.05, by mol) (Nuclel N-925) as a starting material.

PRODUCTION EXAMPLE 2

Production of Compound No. 12

1 liter of toluene and 100 g of ethylene/methacrylic acid copolymer (ethylene/methacrylic acid copolymerization ratio of 0.964/0.036, by mol) (Nuclel N-699) were added to a 2-liter 4-nick container equipped with a reflux condenser with a quantitative water receiver, a stirring blade, a thermometer and an additive-introducing means, and while heating under reflux in an $N_2$ atmosphere, 50 ml of the contents was distilled out. After cooling to 60° C., 15 g of thionyl chloride was gradually added, and 17 g of stearyl alcohol was further added after 1 hour. The temperature was increased to 70° C. and the contents were again reacted for 20 hours.

Next, a mixture comprising 20 ml of water and 150 ml of tetrahydrofuran was added and reacted for an additional 20 hours. The reaction solution was poured into 3 liters of methanol for precipitation. Then the precipitate formed was filtered and washed with methanol and then dried. The IR spectrum and elementary analysis of the product confirmed the product to be a terpolymer of ethylene/methacrylic acid/stearyl methacrylate (molar ratio of a/b/c=0.964/0.018/0.018).

Compound Nos. 11, 13, 15, 16 and 18 were also prepared by the same method as above, using ethylene/methacrylic acid copolymer (ethylene/methacrylic acid copolymerization ratio of 0.964/0.036, by mol) (Nuclel N-699) as a starting material.

Compound Nos. 14 and 17 were also prepared by the same method as above, using ethylene/methacrylic acid copolymer (ethylene/methacrylic acid copolymerization ratio of 0.95/0.05, by mol) (Nuclel N-925) as a starting material.

The copolymerization ratio as above was the value obtained from the ratio of the amounts of the starting materials fed into the reactor. Confirmation of the structure of the product formed was effected by elementary analysis of the product and determination of IR spectrum thereof.

In accordance with the present invention a nonaqueous solvent which has an electric resistance of $1\times10^9$ Ω·cm or more and a dielectric constant of 3 or less can be used as a carrier liquid. Examples of such nonaqueous solvents are linear or branched aliphatic hydrocarbons, alicyclic hydrocarbons, aromatic hydrocarbons or halogenated hydrocarbons. From the viewpoints of volatility, safety, no environmental pollution and odorlessness, octane, isooctane, decane isodecane, dodecane, isododecane, nonane and isoparaffin type petroleum solvents of Isopar E, Isopar G, Isopar H and Isopar L (trade names of the products manufactured by Esso Standard Co., Ltd.) and Shel Sol 71 (a trade name of the product manufactured by Shell Co.) and an aromatic hydrocarbon type solvent of Solvesso 100 (a trade name of the product manufactured by Esso Standard Co., Ltd.) are preferred.

When a colorant is incorporated into the developer of the present invention, any known pigment or dye or a mixture thereof, which has heretofore been used in conventional liquid developers, can be used. For instance, examples include Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil Blue (C.I. 743500), Alkali Blue (C.I. 42770A), Fast Scarlet (C.I. 12315), Rhodamine 6B (C.I. 45160), Fast Sky Blue (C.I. 74200-Lake), Nigrosine (C.I. 54015) and carbon black. Surface-treated pigments, for example, Nigrosine-dyed carbon black or polymer-grafted graft-carbon may also be used.

A known dispersing agent can be incorporated into the liquid developer of the present invention so as to enhance the dispersibility and stability thereof. The dispersing agent is a resin to enhance the dispersibility of the toner and this is dissolved in or swollen by the carrier liquid thereby to increase the dispersibility of toner. For instance, rubbers such as styrene-butadiene, vinyl toluene-butadiene or butadiene-isoprene, polymers of an acrylic monomer having a long chain alkyl group such as 2-ethylhexyl (meth)acrylate, lauryl (meth)acrylate or stearyl (meth)acrylate, copolymers of these monomers with other monomers such as styrene, (meth)acrylic acid or the methyl, ethyl or propyl ester thereof, as well as graft copolymers or block copolymers can be used as the dispersing agent. Of these preferred dispersing agents, synthetic rubber type dispersing agents are especially effective, and random or block copolymers of styrene-butadiene copolymers can be used as an extremely effective dispersing agent.

When the liquid developer of the present invention contains a charge adjusting agent, any conventional agent can be used. For instance, suitable charge adjusting agents include metal salts of fatty acids such as naphthenic acid, octenic acid, oleic acid or stearic acid; metal salts of sulfosuccinic acid esters; oil-soluble metal salts of sulfonic acids as described in JP-B-No. 45-556 (the term "JP-B" as used herein refers to an "examined Japanese patent publication") and JP-A-No. 52-37435 and JP-A-No. 52-37049 metal salts of phosphoric acid esters as described in JP-B-No. 45-9594; metal salts of abietic acid or hydrogenated abietic acid as described in JP-B-No. 48-25666; calcium salts of alkylbenzenesulfonic acids as described in JP-B-No. 55-2620; metal salts of aromatic carboxylic acids or sulfonic acids as described in JP-A-No. 52-107837, JP-A-No. 52-38937, JP-A-No. 57-90643 and JP-A-No. 57-139753; nonionic surfactants such as polyoxyethylated alkylamines; fats and oils such as lecithin or linseed oil; polyvinyl pyrrolidone; organic acid esters of polyhydric alcohols; phosphoric acid ester type surfactants as described in JP-A-No. 57-210345; and sulfonic acid resins as described in JP-B-56-24944. Further, amino acid derivatives as described in JP-A-No. 60-21056 and JP-A-No. 61-50951 may also be used. These amino acid derivatives are compounds as represented by the following general formulae (III) or (IV) or reaction mixtures obtained by reacting an amino acid and a titanium compound in an organic solvent and then further reacting the resulting reaction mixture with water.

(III)

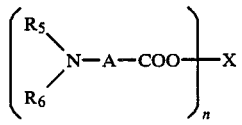

(IV)

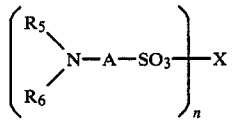

In these formulae, $R_5$ and $R_6$ each represents a hydrogen atom, an alkyl group having from 1 to 12 carbon atoms, a substituted alkyl group (as the substituent for the group, a dialkylamino group, an alkyloxy group and an alkylthio group are suitable), an aryl group having from 6 to 24 carbon atoms, a substituted aryl group (as the substituent for the group, a dialkylamino group, an alkyloxy group, an alkylthio group, a chlorine atom, a bromine atom, a cyano group, a nitro group and a hydroxyl group are suitable), an aralkyl group, an acyl group having from 1 to 22 carbon atoms, an alkylsulfonyl group, an alkylphosphonyl group, an arylsulfonyl group having from 6 to 24 carbon atoms or an arylphosphonyl group. $R_5$ and $R_6$ may be the same or different, and $R_5$–$R_6$ may together form a ring, but these must not be hydrogen at the same time. A represents an alkylene group having from 1 to 10 carbon atoms or a substituted alkylene group. X represents a hydrogen atom, a monovalent to tetravalent metal or a quaternary ammonium cation. n represents a positive integer.

Of these compounds, especially preferred are metal salts of naphthenic acid, metal salts of dioctylsulfosuccinic acid, basic barium sulfonate, lecithin and the above-mentioned amino acid derivatives. In particular, zirconium, cobalt or manganese naphthenate, calcium or sodium dioctylsulfosuccinate, basic barium sulfonate and metal salts of the compounds of the formula (III) above are more preferred. Of the metal salts of the compounds of the formula (III), titanium, cobalt, zirconium or nickel salts are especially preferred.

As the charge adjusting agent, two or more of these compounds may be used in comlination, if desired.

The liquid developer of the present invention can be prepared by conventional methods.

When a colorant is to be incorporated into the liquid developer, a colorant comprising a pigment or dye or a mixture thereof is first heated together with the copolymer of the present invention as the coating agent at a temperature higher than the softening point of the coating agent and kneaded in a mixer such as a Bumbury's mixer, a co-kneader, a kneader, a planetary mixer or a three-roll mixer, and the resulting blend is cooled to obtain a mixture. Various kinds of solvents can be added for preparation of the mixture. Alternatively, the colorant and coating agents are kneaded in a solvent which is compatible with both with a mixer such as a ball mill, a planetary mixer, a kneader or a paint shaker, and the resulting blend is dried or added to a nonsolvent to obtain a mixture.

As still another method of preparing the mixture, the coating agent and colorant are heated, plasticized and kneaded in a solvent such as Isopar L (described in JP-A-No. 61-180248) and then cooled to give a mixture in the form of a sponge. This is also effective.

The thus prepared mixture is pulverized, if desired, with a rotoplex, a pin mill or the like and then wet-triturated, optionally together with a dispersing agent in a sand grinder, a dyno mill, a ball mill or the like to prepare a thick liquid developer stock. The solvent for wet-trituration may be a carrier liquid or an additional solvent such as toluene or acetone may also be added.

The thus prepared toner-containing thick liquid stock is dispersed in a nonaqueous solvent containing a charge adjusting agent to give a liquid developer for electrophotography. The amount of the toner grains in the developer is, although not particularly limited, generally from 0.01 g to 100 g, preferably from 0.1 g to 20 g, per liter of carrier liquid. In the toner grains, when a colorant is used, the copolymer of the present invention as the coating agent can be incorporated in a proportion of from 0.05 to 10 parts by weight, preferably from 0.1 to 2 parts by weight, per part by weight of the colorant. When a colorant is not used, the toner grains comprise the copolymer of the present invention alone.

The amount of the dispersing agent is generally from 0.01 to 50 g, preferably from 0.1 to 10 g, per liter of carrier liquid. For addition of the charge adjusting agent, any method other than that mentioned above may also be employed. For example, it may be added during kneading and/or wet trituration. The amount of the charge adjusting agent to be added is desired to be so controlled that it is present in the developer in an amount of from 0.001 to 10 g per liter of the developer. More preferably, the amount of the charge adjusting agent is from 0.01 g to 1 g per liter of the developer.

The developer of the present invention may be applied to conventional photoreceptors having an organic photoconductor or an inorganic photoconductor. Further, the developer of the present invention can also be used for development of electrostatic latent images formed by not only light exposure of light-sensitive materials but also electro charging of dielectrics with a charging needle.

Organic photoconductors of a broad range are known. Examples thereof include those substances described in *Research Disclosure,* Item 10938 (May, 1973, page 61 and below, an article entitled "Electrophotographic Elements, Materials and Processes").

Examples of electrophotographic photoreceptors which have been put to practical use include an electrophotographic photoreceptor composed of poly-N-vinylcarbazole and 2,4,7-trinitrofluoren-9-one (U.S. Pat. No. 3,484,239); a substance formed by sensitizing poly-N-vinylcarbazole with a pyrylium salt dye (JP-B-No. 48-25658); an electrophotographic photoreceptor composed essentially of an organic pigment (JP-A-No. 49-37543); an electrophotographic photoreceptor composed essentially of an eutectic complex of a dye and a resin (JP-A-No. 47-10735); and an electrophotographic photoreceptor formed by dispersing copper phthalocyanine in a resin (JP-B-No. 52-1667).

In addition, the substances described in *Journal of Electrophotographic Association Japan,* Vol. 25, No. 3, pages 62 to 76 (1986) are suitable.

The developer of the present invention may also be used in a method of forming a printing plate where a dispersion formed by dispersing an organic photoconductor in an alkali-soluble resin such as a phenol resin is coated on an electroconductive support such as aluminum, developed with a developer and then etched with an aqueous alkaline solution to produce a printing plate (as disclosed in JP-B-No. 37-17162 and JP-A-No. 55-19063, JP-A-No. 55-161250 and JP-A-No. 57-147656). In such method, the developer of the present invention has excellent etching resistance.

Examples of inorganic photoconductors include various inorganic compounds described in R. M. Schaffert, *Electrophotography* (published by Focal Press, London, 1975), pages 260 to 374. Specific examples of these compounds include zinc oxide, zinc sulfide, cadmium sulfide, selenium, selenium-tellurium alloy, seleniumarsenic alloy, selenium-tellurium-arsenic alloy. In addition, amorphous silicon is suitable.

The liquid developer of the present invention which is characterized by containing the aforesaid particular ethylene copolymer has excellent transferability and has stable dispersibility and charging characteristics for a long period of time. Further, it has excellent resolving characteristic and provides images with high quality.

The following examples illustrate formation of coating agents and liquid developers of the present invention as well as the use thereof, which, however, are not intended to restrict the scope of the present invention.

EXAMPLE 1

A composition comprising the following components was fed into a TK Loss Double Planetary Mixer 130 LDM Type (manufactured by Tokushuki Kako K.K.) and kneaded by stirring at a rotation speed of 50 rpm for 1 hour at 95° C.

| Copolymer of the Invention | parts by weight |
|---|---|
| Compound No. 1 | 3 |
| Carbon Black #40 | 1 |
| Isopar L | 3 |

Then, 9 parts by weight of Isopar L was further added portionwise thereto with continuous stirring over a period of 2 hours.

Next, the resulting mixture was released over a stainless steel vat and cooled to room temperature to obtain a spongy mixture.

The mixture was fed into a paint shaker (having glass beads with a diameter of about 4 mm media) (manufactured by Toyo Seiki K.K.) in the form of a composition as described below and pre-dispersed therein for 20 minutes.

| | parts by weight |
|---|---|
| Mixture | 1 |
| Isopar H | 6 |

The resulting pre-mixture was then wet-dispersed in Dyno mill KDL Type (having glass beads with a diameter of from about 0.75 to about 1 mm as media) (manufactured by Synmal Enterprises K.K.) at a rotation speed of 4,500 rpm for 6 hours to obtain a thick dispersion.

To the resulting dispersion were added Isopar G and basic barium petronate (manufartured by Witco Chemical Co.) as a charge adjusting agent such that the content of the solid components of the dispersion became 1 g per liter of Isopar G and the solid content of the basic barium petronate became 0.1 g per liter of Isopar G. Thus, liquid developer Sample (A) was prepared.

Next, comparative liquid developer Sample (B) was prepared in the same manner as above, except that ethylene/methacrylic acid copolymer (ethylene/methacrylic acid copolymerization ratio of 0.964/0.036, by mol) (Nuclel N-699) was used in place of Compound No. 1 (Copolymer of the Invention).

The grain size of each cf the samples (measured with an apparatus for grain size determination by centrifugal sedimentation type light transmission method (CAPA-No. 500, manufactured by Horiba Seisaku-sho K.K.)) and the charged amount thereof (measured with the charge determining apparatus described in JP-A-No. 57-58176) were as shown in Table 1 below. The polarity of the two was minus.

TABLE 1

| | Grain Size (weight average) (μm) | Charged Amount T (bulk) (mV) | Charged Amount I (supernatant) (mV) |
|---|---|---|---|
| Developer (A) | 0.80 | 22.0 | 11.0 |
| Comparative Developer (B) | 2.7 | 15.5 | 10.0 |

The charge amount T means the value of the developer bulk, and the charge amount I means the value of the developer supernatant (obtained by centrifugation of the developer). The latter means the value based on the ion components in the carrier liquid. If the value of (T−I) is larger, the effective charge is larger, while if the value of (I/T) is smaller, the value of the ion components in the charged amount is smaller. This case is advantageous as a developer.

Developer (A), as compared with Comparative Developer (B), has a smaller grain size, which means that the dispersibility of (A) is better than (B). It is believed that this effect resulted from the long chain alkyl group in the ethylene copolymer having a high affinity to the carrier liquid.

Comparing the charging characteristic in the two samples, Developer (A) had a larger charged amount (T) than Developer (B) and the aforesaid effective charge (T−I) was larger in (A) than in (B). Accordingly, it is noted that Developer (A) was superior to (B) in charging characteristic.

Next, 10 g of a polycarbonate (Lexan 121, a trade name, manufactured by G.E.), 6 g of a diarylamide compound described below and 60 mg of a styryl dye described below (as a sensitizing agent) were dissolved in 80 ml of methylene chloride.

Next, the resulting solution was coated on a 100 μm thick polyethylene terephthalate film having a palladium-plated layer with a wire bar, and dried to remove the coating solvent therefrom to form a 6 μm thick photoconductive layer thereon. Thus, an electrophotographic photoreceptor was prepared. The surface of the film was charged to a potential of +400 V, and the film was imagewise exposed through a positive original to form an electrostatic latent image thereon.

Diarylamine Compound:

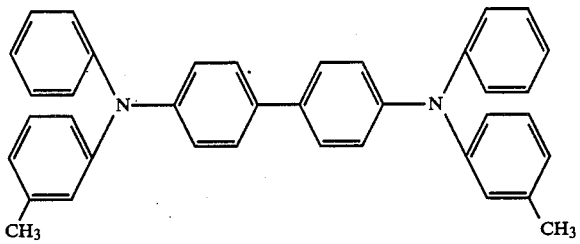

Styryl Dye:

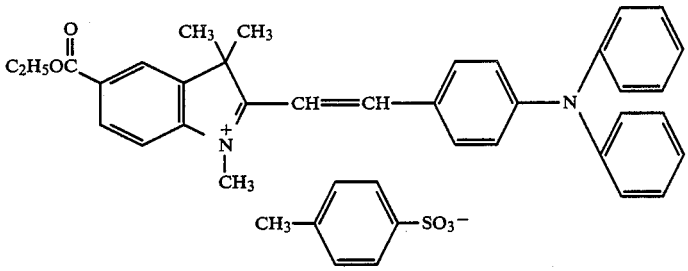

Using the aforesaid Developer (A) and Comparative Developer (B), the electrostatic latent image was developed. The image formed with (A) was compared with that formed with (B). In the latter, the edge parts and the line part were noticeably rough, while in the former there was almost no rough parts observed. Accordingly, it is noted that Developer (A) had an excellent image reproducibility.

Next, the surface of a photographic material having an image as formed thereon was subjected to minus corona discharge (−6 kV) and then set on an aluminum plate for PS Plate FPD-II (manufactured by Fuji Photo Film Co., Ltd.). Transfer printing was conducted by applying a corona discharge (minus) which was homopolar to the toner to the side of the photographic material, whereupon the image was transferred almost completely with nearly 100% transfer percentage.

The transfer percentage was calculated from the following formula:

$$\text{Transfer Percentage} = \frac{(D_S - D_R)}{D_S} \times 100$$

$D_S$: Image density on photographic material before transfer $D_R$: Image density on photographic material after transfer The transferred images were compared. The transferred image formed with (A) was found better than that with (B) in that the former had neither flow nor blur in the image.

Next, the image as transferred to the aluminum plate was subjected to printing testing in accordance with the procedure described below.

First, the image-transferred aluminum plate was heated at 120° C. for 5 minutes so that the image was fixed thereon, and then this was surface-treated by gum coating. Next, the plate was set in a printing machine (Davidson 500) and subjected to printing test for determination of printing durability. After the test, it was confirmed that 30,000 or more prints were formed from both plates (prepared by the use of (A) or (B)) with no difficulty. Thus, both plates were confirmed to have an excellent printing durability.

EXAMPLE 2

Developer (C) and Comparative Developer (D) were prepared in the same manner as in Example 1, except that the compound represented by the following formula (III) was used as a charge adjusting agent in an amount of $1\times10^{-4}$ mol per liter of Isopar. G.

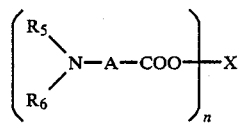

(III)

wherein $R_5$=n-$C_8H_{17}$; A=$C_2H_4$; $R_6$=n-$C_{13}H_{27}CO$; n=2; X=Ti

The grain size and the charged amount of the two samples were as shown in Table 2 below.

TABLE 2

| | Grain Size (weight average) (μm) | Charged Amount T (mV) | Charged Amount I (mV) |
|---|---|---|---|
| Developer (C) | 0.90 | 20.0 | 15.0 |
| Comparative Developer (D) | 2.8 | 5.0 | 4.5 |

As is noted from the above, the charged amount of Developer (C) was larger than that of Comparative Developer (D), and the effective charge in Comparative Devloper (D) was almost zero. Comparative Devloper (D) comprised almost ion components only. This result means that the charging characteristic was changed advantageously by esterification of the carboxyl group in the methacrylic acid in the ethylene/methacrylic acid copolymer.

Next, development was conducted in the same manner as in Example 1. As a result, the so-called double images (caused by image-flowing or ghost around linear images) were formed in the prints developed with Comparative Developer (D). In contrast, neither image-flowing nor double image in the prints formed with Developer (C) occurred, and the edge parts of the images formed were not rough to any substantial extent. Thus, the image reproducibility of Developer (C) was good. Further, the transferability of Developer (C) was also good, and the transfer percentage was nearly 100%, like the case in Example 1.

EXAMPLES 3 TO 6

Developers (E) to (H) were prepared in the same manner as in Example 1, except that the copolymer as indicated in Table 3 below was used in place of Compound No. 1. The grain size and the charged amount of each developer thus prepared were as shown in Table 3.

TABLE 3

| Example No. | | Compound No. | Grain Size (weight average) (μm) | Charged Amount T (mV) | Charged Amount I (mV) |
|---|---|---|---|---|---|
| Example 3 | Developer (E) | 3 | 1.1 | 20.0 | 11.0 |
| Example 4 | Developer (F) | 4 | 0.90 | 21.0 | 12.0 |
| Example 5 | Developer (G) | 6 | 1.3 | 18.0 | 10.5 |
| Example 6 | Developer (H) | 7 | 1.1 | 19.0 | 11.0 |

From Table 3 above, all the developers were found better than Comparative Developer (B) in Example 1 in terms of dispersibility and charging characteristic.

Next, development was effected in the same manner as in Example 1 using each of the developers. As a result, the edge parts of the formed images were not rough and the image reproducibility was good in all of the developers. The transferability was also tested in the same manner as in Example 1, and as a result, all the developers were found to have excellent transfer characteristics with a transfer efficiency of from 90 to 100%.

EXAMPLE 7

The mixture prepared in Example 1 (the mixture of Compound No. 1, carbon black #40 and Isopar L) was wet-dispersed in the same manner as in Example 1, whereupon Solplene 1205 (a trade name of the product manufactured by Asahi Kasei Co.; styrene/butadiene copolymer with styrene/butadiene copolymerization ratio of 0.75/0.25 by weight) was incorporated into the mixture as a dispersing polymer in the proportion mentioned below.

| | parts by weight |
|---|---|
| Mixture | 1 |
| Isopar H | 6 |
| Solplene 1205 (10 wt % solution in Isopar H) | 2.5 |

The composition was dispersed in the same manner as in Example 1 using Isopar G and basic barium petronate to produce Developer (I).

The grain size and the charged amount of the developer were measured and were as shown in Table 4 below.

TABLE 4

| | Grain Size (weight average) (μm) | Charged Amount T (mV) | Charged Amount I (mV) |
|---|---|---|---|
| Developer (I) | 0.70 | 23.5 | 11.0 |

From the data in Table 4, it is noted that the dispersibility and the charging characteristic of the developer were improved better because of the incorporation of the dispersing polymer thereinto. Using Developer (I), the same development as in Example 1 was conducted, whereupon neither image flow nor rough edge was observed in the images formed. Thus, the image reproducibility was excellent. The transferability was also tested in the same manner as mentioned above, and as a result, the transferability was found excellent having a transfer efficiency of from 95 to 100%.

EXAMPLE 8

The following components were fed into a TK Loss Double Planetary Mixer 130 LMD Type (manufactured by Tokush Kika K.K.) and stirred and kneaded at a rotation speed of 50 rpm for 1 hour at 95° C.

| Copolymer of the Invention | parts by weight |
|---|---|
| Compound No. 1 | 3 |
| Carbon Black (Mogul L, a trade name manufactured by Cabott Co.) | 1 |
| Solvesso 100 (manufactured by Esso Standard Co.) | 3 |

37 parts by weight of Solvesso 100 was further added and stirred for further 1 hour to obtain a mixture. Next, the mixture was cooled to 50° C. and added to 200 parts by weight of Isopar H to form a reprecipitate.

The resulting reprecipitate was dispersed in the same manner as in Example 1 and basic barium petronate as a charge adjusting agent was added thereto to obtain Developer (J). The grain size and the charged amount of the sample were measured and were as shown in Table 5 below. Developer (J) had almost the same physical data as those of Developer (A) obtained in Example 1.

TABLE 5

| | Grain Size (weight average) (μm) | Charged Amount T (mV) | Charged Amount I (mV) |
|---|---|---|---|
| Developer (J) | 0.85 | 21.0 | 10.5 |

Next, development, transfer and printing were conducted in the same manner as in Example 1, using Developer (J) thus obtained. As a result, it was confirmed that Developer (J) had the same capacity as that of Developer (A) in Example 1.

EXAMPLE 9

Liquid Developer (K) was prepared in the same manner as in Example 1, except that the same amount of Copolymer of Compound No. 12 was used in place of the Copolymer of Compound No. 1 used in Example 1.

Next, Comparative Liquid Developer (L) was prepared also in the same manner, except that ethylene/methacrylic acid copolymer (ethylene/methacrylic acid copolymerization ratio of 0.964/0.036 by mol; Nuclel N-699) was used in place of the copolymer of the present invention, Compound No. 12. The grain size and the charged amount of Liquid Developers (K) and (L) were measured in the same manner as in Example 1 and were as shown in Table 6 below.

TABLE 6

| | Grain Size (weight average) (μm) | Charged Amount T (bulk) (mV) | Charged Amount I (supernatant) (mV) |
|---|---|---|---|
| Developer (K) | 1.4 | 19.0 | 10.0 |
| Comparative Developer (L) | 2.7 | 15.5 | 10.0 |

From the results in Table 6, the following are noted: Developer (K), as compared with Comparative Developer (L), has a smaller grain size, which means that the dispersibility of (K) is better than (L). It is believed that the effect resulted from the long chain alkyl group in the ethylene copolymer having a high affinity to the carrier liquid.

Comparing the charging characteristic in the two samples, Developer (K) had a larger charged amount (T) than Developer (L) and the effective charge (T−I) was larger in (K) than in (L). Accordingly, it is noted that Developer (K) was superior to (L) in charging characteristic.

Next, electrostatic latent images were developed in the same manner as in Example 1, using Developer (K) and Comparative Developer (L). The image formed with Developer (K) was compared with that formed with Comparative Developer (L). In the latter the edge parts and the line parts were noticeably rough, while in the former there was almost no rough parts. Accordingly, it is noted that Developer (K) had an excellent image reproducibility.

Next, the transferability of Developers (K) and (L) was determined in the same manner as in Example 1. As a result, the transfer percentage was nearly 100% in the two samples, and the transferability thereof was almost perfect.

The two transferred images were compared. The transferred image formed with Developer (K) was found better than that with Comparative Enveloper (L) in that the former had neither flow nor blur (ghost) in the image.

Next, the image thus transferred on the aluminum plate was subjected to printing testing in the same manner as in Example 1. As a result of the test, it was confirmed that 50,000 or more prints were formed from both plates (prepared by the use of Developers (K) or (L)) with no difficulty. Thus, both plates were confirmed to have an excellent printing durability.

EXAMPLE 10

Developer (M) and Comparative Developer (N) were prepared in the same manner as in Example 9, except that the compound represented by the following formula (III) was used as a charge adjusting agent in an amount of $1\times10^{-4}$ mol per liter of Isopar G.

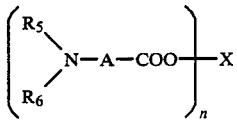

(III)

wherein $R_5$=n-$C_8H_{17}$; A=$C_2H_4$; $R_6$=n-$C_{13}H_{27}CO$; n=2; X=Ti

The grain size and the charged amount of the two samples were as shown in Table 7 below.

TABLE 7

| | Grain Size (weight average) (μm) | Charged Amount T (mV) | Charged Amount I (mV) |
|---|---|---|---|
| Developer (M) | 1.4 | 15.0 | 10.5 |
| Comparative Developer (N) | 2.8 | 5.0 | 4.5 |

As is noted from the above, the charged amount of Comparative Developer (N) was smaller than that of Developer (M), and the effective charge was almost zero in Comparative Developer (N), Comparative Developer (N) comprised almost ion components only. This result means that the charging characteristics were changed advantageously by esterification of the carboxyl group in the methacrylic acid in the ethylene/methacrylic acid copolymer.

Next, development was conducted in the same manner as in Example 9. As a result, the so-called double images (caused by image-flowing or ghost around line images) were formed in the prints developed with Comparative Developer (N). In contrast, neither image-flowing nor double image in the prints were formed with Developer (M), and the edge parts of the images formed were almost not rough. Thus, the image reproducibility of Developer (M) was good. Further, the transferability of Developer (M) was also good, and the transfer percentage was nearly 100%, like the case in Example 9.

EXAMPLES 11 TO 14

Developers (0) to (R) were prepared in the same manner as in Example 9, except that the copolymer as indicated in Table 8 below was used. The grain size and the charge amount of each developer thus prepared were as shown in Table 8.

TABLE 8

| Example No. | | Compound No. | Grain Size (weight average) (μm) | Charged Amount T (mV) | Charged Amount I (mV) |
|---|---|---|---|---|---|
| Example 11 | Developer (O) | 11 | 1.2 | 20.0 | 10.0 |
| Example 12 | Developer (P) | 13 | 1.3 | 19.0 | 10.0 |
| Example 13 | Developer (Q) | 14 | 1.6 | 18.0 | 10.0 |
| Example 14 | Developer (R) | 15 | 1.5 | 18.5 | 10.0 |

From Table 8 above, all the developers were found better than Comparative Developer (L) in Example 9 in dispersibility and charging characteristics.

Next, development was effected in the same manner as in Example 9, using each of the developers. As a result, the edge parts of the formed images were not rough and the image reproducibility was good in all the developers.

The transferability was also tested in the same manner as in Example 9 and, as a result, all the developers were found to have an excellent transfer characteristic with a transfer efficiency of from 90 to 100%.

EXAMPLE 15

Developer (S) was prepared in the same manner as in Example 9, except that Compound No. 18 was used as the copolymer.

Developer (T) was prepared also in the same manner, whereupon the charge adjusting agent mentioned in Example 10 was added. The grain size and charged amount of these developers were measured and were as shown in Table 9 below.

TABLE 9

| | Grain Size (weight average) (μm) | Charged Amount T (mV) | Charged Amount I (mV) |
|---|---|---|---|
| Developer (S) | 1.5 | 18.5 | 10.0 |
| Developer (T) | 1.5 | 12.5 | 9.5 |

Comparing the copolymer used in Example 15 and those used in Examples 9 and 10, the copolymerization ratio by mol of methacrylic acid/stearyl methacrylate was 0.03/0.006 (5/1) in the former, while it is 0.018/0.018 (1/1) in the latter. The grain size of the developers formed in Example 15 was almost the same as that in Example 9. This means that incorporation of a small amount of stearyl methacrylate resulted in an improvement in the dispersibility of the developer formed. Developer (T) was noted to have a smaller charged amount than Developer (M) in Example 10. This means that the charging characteristics of the charging adjusting agents of the formula (III) of a certain type are influenced by the methacrylic acid moiety, that is, the carboxyl group thereof.

Next, development was conducted in the same manner as in Example 9. As a result, images having almost no roughness in the edge parts and having excellent resolving characteristics were obtained with both Developers (S) and (T). Although some image flowing was noted in the image formed with Developer (T), as compared with Developer (S), the quality of the image formed with Developer (T) was far superior to that formed with Comparative Developer (N).

Then, transfer was effected in the same manner as in Example 9. As a result, the transfer efficiency was 90% or more in both cases using Developers (S) and (T) and the transferability was good in both cases.

EXAMPLE 16

The mixture prepared in Example 9 was wet-dispersed in the same manner as in Example 9, whereupon Solplene 1205 (produced by Asahi Kasei Co.; styrene/butadiene copolymer with styrene/butadiene copolymerization ratio of 0.75/0.25 by weight) was incorporated into the mixture as a dispersing polymer in the proportion mentioned below.

| | parts by weight |
|---|---|
| Mixture | 1 |
| Isopar H | 6 |
| Solplene 1205 (10 wt % solution in Isopar H) | 2.5 |

The composition was dispersed in the same manner as in Example 9 to produce Developer (U).

The grain size and the charged amount of the developer were measured and were as shown in Table 10 below.

TABLE 10

| | Grain Size (weight average) (μm) | Charged Amount T (mV) | Charged Amount I (mV) |
|---|---|---|---|
| Developer (U) | 1.0 | 21.0 | 10.5 |

From the data in Table 10, it is noted that the dispersibility and the charging characteristics of the developer were improved more because of the incorporation of the dispersing polymer thereinto. Using Developer (U), the same development as in Example 9 was conducted, whereupon neither image flow nor rough edge was observed substantially in the images formed. Thus, the image reproducibility was excellent. The transferability was also tested in the same manner as mentioned above and, as a result, the transferability was found excellent having a transfer efficiency of from 95 to 100%.

EXAMPLE 17

The following components were fed into a TK Loss Double Planetary Mixer 130 LMD Type (manufactured by Tokushu Kika K.K.) and stirred and kneaded at a rotation speed of 50 rpm for 1 hour at 95° C.

| Copolymer of the Invention | parts by weight |
|---|---|
| Compound No. 12 | 3 |
| Carbon Black (Mogul L) | 1 |
| Solvesso 100 | 3 |

37 parts by weight of Solvesso 100 was further added and stirred for further 1 hour to obtain a mixture. Next, the mixture was cooled to 50° C and added to 200 parts by weight of Isopar H to form a reprecipitate. The resulting reprecipitate was dispersed in the same manner as in Example 9 and basic barium petronate as a charge adjusting agent was added thereto to obtain Developer (V). The grain size and the charged amount of the sample were measured and were as shown in Table 11 below.

TABLE 11

| | Grain Size (weight average) (μm) | Charged Amount T (mV) | Charged Amount I (mV) |
|---|---|---|---|
| Developer (V) | 1.5 | 18.5 | 10.0 |

Developer (V) had almost the same physical data as those of Developer (K) obtained in Example 9.

Next, development, transfer and printing were conducted in the same manner as in Example 9, using Developer (V) thus obtained. As a result, it was confirmed that Developer (V) had the same capacity as that of Developer (K) in Example 9.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic images comprising a carrier liquid containing at least one copolymer represented by the following general formula (I):

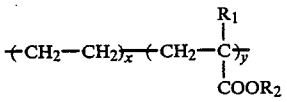

(I)

wherein $R_1$ represents a hydrogen atom or a methyl group; $R_2$ represents an alkyl group, an aralkyl group, an aryl group or a cycloalkyl group, which may be substituted; and x and y each represents a number to satisfy the condition of x/y=0.995 to 0.80/0.005 to 0.20 on a molar basis.

2. A liquid developer for electrostatic images as claimed in claim 1, wherein the copolymer is represented by the following general formula (II):

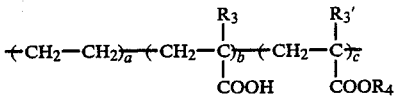

(II)

wherein $R_3$ and $R_3'$ each has the same meaning as $R_1$ in the formula (I); $R_4$ has the same meaning as $R_2$ in the formula (I); and a, b and c each represents a number to satisfy the condition of a/b/c=0.99 to 0.80/0.005 to 0.195/0.195 to 0.005 on a molar basis.

3. A liquid developer for electrostatic images as claimed in claim 1 or 2, which further contains a dispersing agent.

4. A liquid developer for electrostatic images as claimed in claim 1 or 2, which further contains a charge adjusting agent.

5. A liquid developer for electrostatic images as claimed in claim 1, wherein the alkyl group, the aralkyl group or the aryl group represented by $R_2$ is substituted by an alkyl group having up to 12 carbon atoms, an alkyloxy group having up to 12 carbon atoms, an aryloxy group having from 6 to 14 carbon atoms, an alkyloxycarbonyl group having up to 12 carbon atoms, an aryloxycarbonyl group having from 6 to 14 carbon atoms, a dialkylcarbonyl group having up to 12 carbon atoms, a diarylcarbonyl group having from 13 to 28 carbon atoms, an alkylarylcarbonyl group having from 8 to 18 carbon atoms, a hydroxyl group, a carboxyl group, a cyano group, a nitro group, a sulfonic acid group, a cycloalkyl group having from 4 to 12 carbon atoms, an aryl group having from 6 to 14 carbon atoms, an aralkyl group having from 7 to 14 carbon atoms or a halogen atom.

6. A liquid developer for electrostatic images as claimed in claim 1, wherein the copolymer has a weight-average molecular weight of from about 10,000 to 1,000,000.

7. A liquid developer for electrostatic images as claimed in claim 1, wherein the amount of the copolymer is from 0.01 g to 100 g per liter of the carrier liquid.

8. A liquid developer for electrostatic images as claimed in claim 1, wherein the carrier liquid is a nonaqueous solvent having an electric resistance of $1\times10^9\Omega\cdot$cm or more and a dielectric constant of 3 or less.

9. A liquid developer for electrostatic images as claimed in claim 2, wherein the alkyl group, the aralkyl group or the aryl group represented by $R_4$ is substituted by an alkyl group having up to 12 carbon atoms, an alkyloxy group having up to 12 carbon atoms, an aryloxy group having from 6 to 14 carbon atoms, an alkyloxycarbonyl group having up to 12 carbon atoms, an aryloxycarbonyl group having from 6 to 14 carbon atoms, a dialkylcarbonyl group having up to 12 carbon atoms, a diarylcarbonyl group having from 13 to 28 carbon atoms, an alkylarylcarbonyl group having from 8 to 18 carbon atoms, a hydroxyl group, a carboxyl group, a cyano group, a nitro group, a sulfonic acid group, a cycloalkyl group having from 4 to 12 carbon atoms, an aryl group having from 6 to 14 carbon atoms, an aralkyl group having from 7 to 14 carbon atoms or a halogen atom.

10. A liquid developer for electrostatic images as claimed in claim 2, wherein the copolymer has a weight-average molecular weight of from about 10,000 to 1,000,000.

* * * * *